US010159322B2

(12) United States Patent
Yu

(10) Patent No.: US 10,159,322 B2
(45) Date of Patent: Dec. 25, 2018

(54) LUGGAGE COVER WITH CARRYING ELEMENT

(71) Applicant: Olympia International, Inc., Torrance, CA (US)

(72) Inventor: Chris Yu, Torrance, CA (US)

(73) Assignee: Olympia International, Inc., Torrance, CA (US)

( * ) Notice: Subject to any disclaimer, the term of this patent is extended or adjusted under 35 U.S.C. 154(b) by 247 days.

(21) Appl. No.: 15/015,023

(22) Filed: Feb. 3, 2016

(65) Prior Publication Data

US 2017/0215537 A1 Aug. 3, 2017

(51) Int. Cl.

| | |
|---|---|
| ***A45C 13/00*** | (2006.01) |
| ***A45C 13/10*** | (2006.01) |
| ***A45F 3/04*** | (2006.01) |

(52) U.S. Cl.

CPC ..... *A45C 13/002* (2013.01); *A45C 13/103* (2013.01); *A45C 13/1092* (2013.01); *A45F 3/04* (2013.01); *A45C 2013/1015* (2013.01)

(58) Field of Classification Search

CPC . A45C 13/002; A45C 13/103; A45C 13/1092; A45C 2013/1015; A45C 13/262; A45C 5/14; A45F 3/04

See application file for complete search history.

(56) References Cited

U.S. PATENT DOCUMENTS 2,617,504 A * 11/1952 Meyers ..... A45C 13/002 190/26
7,458,452 B2 * 12/2008 Beakey ..... A45C 13/002 150/105
8,267,230 B2 * 9/2012 Johnson ..... A45C 13/002 150/105
2003/0116392 A1 * 6/2003 Oh ..... A45C 13/002 190/102
2004/0100046 A1 * 5/2004 Darling ..... B60N 2/2845 280/30
2006/0086444 A1 * 4/2006 Yu ..... A45C 13/002 150/154

(Continued)

FOREIGN PATENT DOCUMENTS

JP 2001161423 6/2001

OTHER PUBLICATIONS

Korean Intellectual Property Office Application Serial No. 20-2016-0004449, Office Action dated Jun. 12, 2017, 2 pages.

*Primary Examiner* — Corey Skurdal
(74) *Attorney, Agent, or Firm* — Lee, Hong, Degerman, Kang & Waimey

(57) ABSTRACT

A luggage cover includes: a front panel, a rear panel, a top panel, a bottom panel, a first side panel, a second side panel, and a carrying element affixed to a top portion of the rear panel, wherein: the bottom panel includes a first panel coupled to an edge portion of the front panel and a second panel coupled to an edge portion of the rear panel; the first panel includes a first fastening element that can be coupled to a second fastening element of the second panel such that the bottom panel can be in a closed configuration or in an open configuration based on whether or not the first fastening element and the second fastening element are coupled; and the luggage cover is configured to receive the luggage container in the open configuration and is formed from pliable material to permit folding.

19 Claims, 11 Drawing Sheets

(56) References Cited

U.S. PATENT DOCUMENTS

| | | | | |
|---|---|---|---|---|
| 2006/0151560 | A1 | 7/2006 | Chen | |
| 2016/0015140 | A1* | 1/2016 | Estrella | A45C 13/002 150/154 |

* cited by examiner

LUGGAGE COVER WITH CARRYING ELEMENT

BACKGROUND

Field

The present invention relates to generally to a luggage cover. More specifically, the present invention relates to a luggage cover that can be used as a bag or backpack when a luggage container is enclosed within the luggage cover.

Background

A challenge to traveling has always been carrying one's belongings in the most efficient and easy manner. Further, there has always been a need to protect one's luggage from exposure to natural elements, general wear-and-tear, and overall deterioration, just as there has always been a need for luggage to effectively protect the contents placed within. The need to protect luggage from such conditions has increased more so due to the rising cost of quality-crafted luggage and subsequent maintenance. These costs are compounded by the fact that some luggage items are manufactured with perishable materials such as leather and are subject to a higher rate of deterioration.

To meet this challenge, luggage cover designs have appeared in the prior art to protect luggage. However, prior art designs have had various problems concerning carriability. That is, once a luggage container is enclosed within a protective luggage cover, it is difficult to carry the luggage container because all handles are covered by the luggage cover. The present invention is designed to provide a luggage cover that provides not only protection of the luggage, but also functionality as a backpack.

SUMMARY

Accordingly, the present invention is directed to an improved luggage cover that substantially obviates one or more of the problems due to limitations and disadvantages of the related art. According to one embodiment of the present invention, a luggage cover for covering a luggage container includes: a plurality of panels including a front panel, a rear panel, a top panel, a bottom panel, a first side panel, and a second side panel, the plurality of panels capable of being shaped into a protective shell for covering the luggage container; and a carrying element affixed to a top portion of the rear panel.

In one aspect of the present invention, the bottom panel includes a first panel coupled to an edge portion of the front panel and a second panel coupled to an edge portion of the rear panel; and the first panel includes a first fastening element that is configured to be coupled to a second fastening element of the second panel such that the bottom panel is in a closed configuration when the first fastening element and the second fastening element are coupled and the bottom panel is in an open configuration when the first fastening element and the second fastening element are not coupled or uncoupled. In another aspect of the present invention, the luggage cover is configured to receive the luggage container in the open configuration and is formed from pliable material to permit folding.

Advantages of the present invention over the prior art include a carrying element such as shoulder straps attached to the luggage cover that allows carrying the luggage container enclosed within the luggage cover just like a bag or backpack. The shoulder straps may be detachable when the luggage container enclosed within the luggage cover is not carried by a user.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF EMBODIMENTS

Hereinafter, the present invention will be described with respect to various embodiments illustrated in the annexed drawings.

Figure 1:
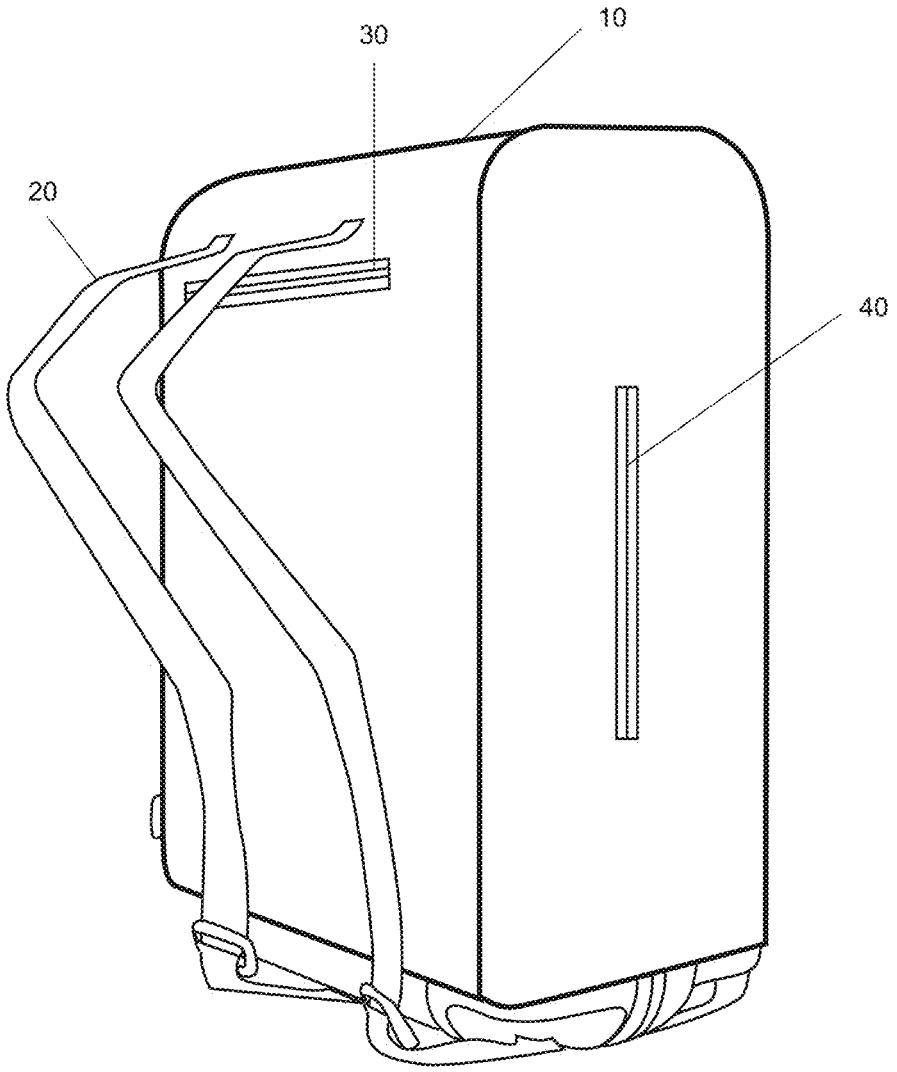
FIG. 1 is a rear perspective view of a luggage cover with detachable shoulder straps attached thereto according to an embodiment of the present invention.

FIG. 1 is a rear perspective view of a luggage cover with detachable shoulder straps attached thereto according to an embodiment of the present invention. Referring to FIG. 1, a luggage cover 10 in which a luggage container is enclosed is shown. In all drawings, the luggage cover 10 is shown to enclose the luggage container. The luggage cover 10 is shaped to cover the luggage container. For example, the luggage cover 10 is formed of any durable material, such as canvas, fabric, polyester, spandex, nylon, leather, plastic (e.g. vinyl), and the like.

The luggage cover 10 may have a carrying element attached thereto. For example, the carrying element may be a single shoulder strap or a pair of shoulder straps 20. According to an embodiment, the shoulder straps 20 may be detached from the luggage cover 10 and stored in a pocket 30 formed inside the luggage cover 10. According to another embodiment, only one of the shoulder straps 20 may be attached to the luggage cover 10 while the other shoulder strap 20 may be stored in the pocket 30. The opening of the pocket 30 is sealable by a zipper mechanism.

According to an embodiment, the luggage cover 10 may have at least one aperture 40 that can be opened and closed by a zipper mechanism. For example, an aperture 40 may be formed on a side panel of the luggage cover 10. The aperture 40 may be used to expose an external component of the luggage container within the luggage cover 10 such as a handle or carrying means.

Figure 2:
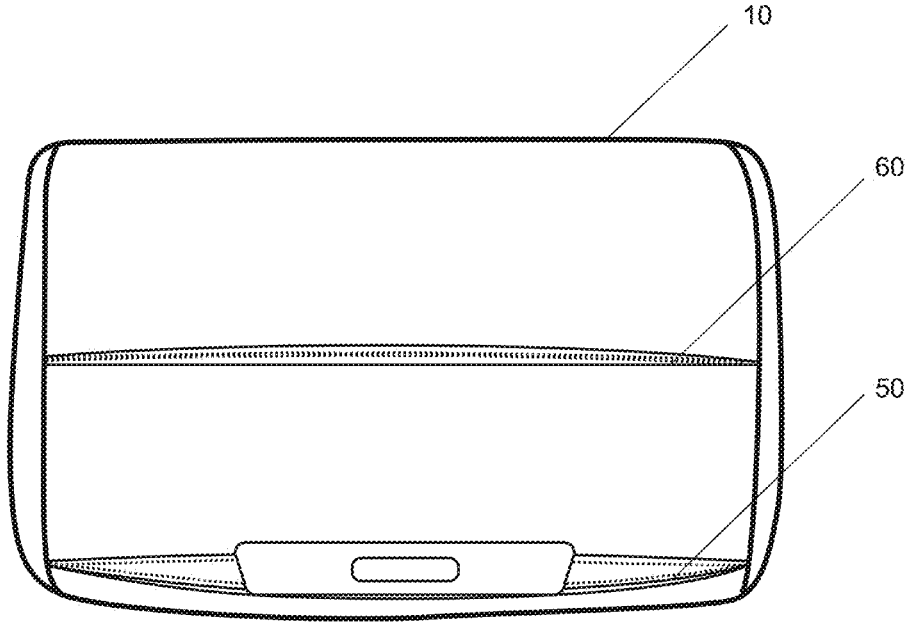
FIG. 2 is a top plan view of a luggage cover according to an embodiment of the present invention.

FIG. 2 is a top plan view of a luggage cover according to an embodiment of the present invention. Referring to FIG. 2, the luggage cover 10 may have at least one or two apertures 50, 60 formed on a top panel of the luggage cover 10. The at least one or two apertures 50, 60 may be opened and closed by a zipper mechanism and when opened, the at least one or two apertures 50, 60 can be used to expose external component(s) of the luggage container such as an extendable handle or carrying means attached to the luggage container. For example, in FIG. 2, a carrying handle extended from the luggage container is exposed via the aperture 50.

Figure 3:
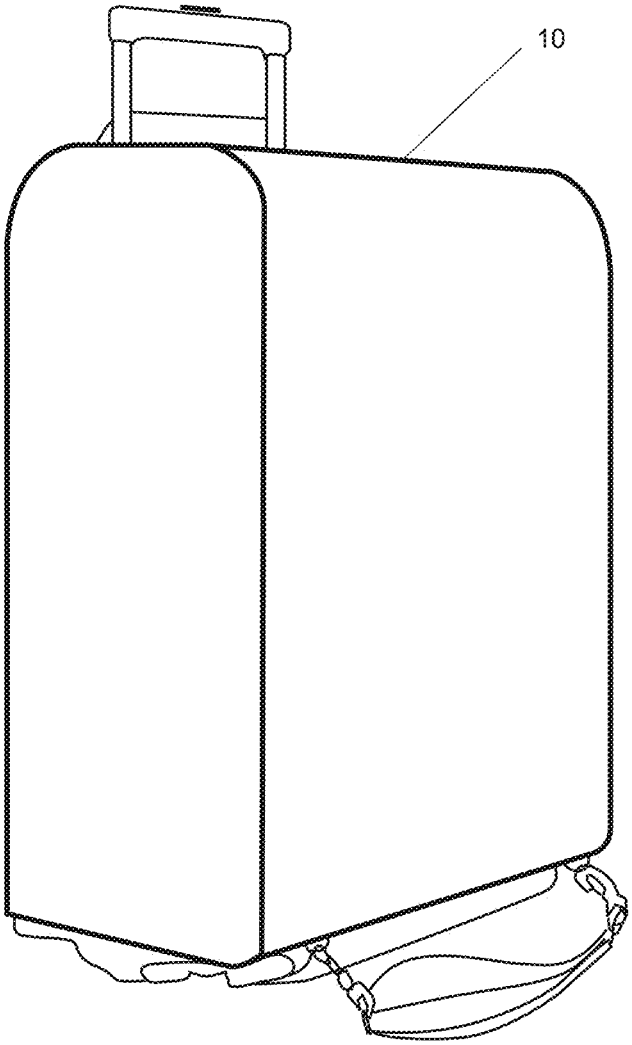
FIG. 3 is a front perspective view of a luggage cover according to an embodiment of the present invention.
Figure 4:
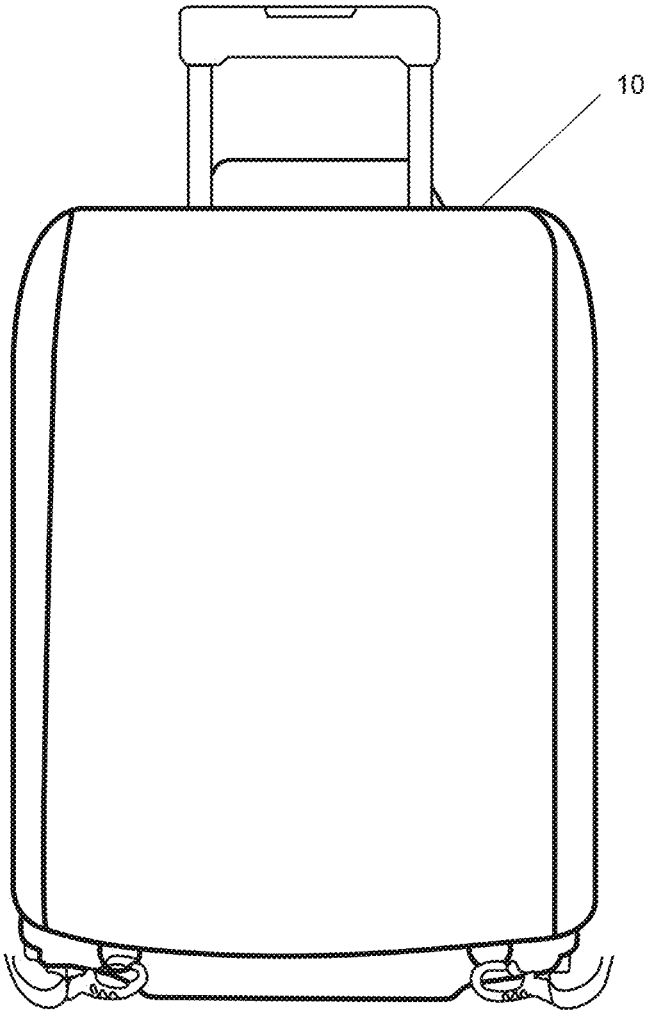
FIG. 4 is a frontal view of a luggage cover according to an embodiment of the present invention.

FIG. 3 is a front perspective view of a luggage cover according to an embodiment of the present invention. FIG. 4 is a frontal view of a luggage cover according to an embodiment of the present invention. Referring to FIGS. 3 and 4, the carrying handle of the luggage container is exposed via the at least one or two apertures 50, 60 that are open. Since at least two of a plurality of panels of the luggage cover 10 are made of an expandable material or expandable fabric, a size of the luggage cover is adjustable according to a size of the luggage container to fit the luggage container. Thus, the luggage cover 10 may be used to cover various sized luggage containers regardless of their sizes. Further, the luggage cover 10 is foldable and when folded, the luggage cover 10 is storable in the luggage container.

Figure 5:
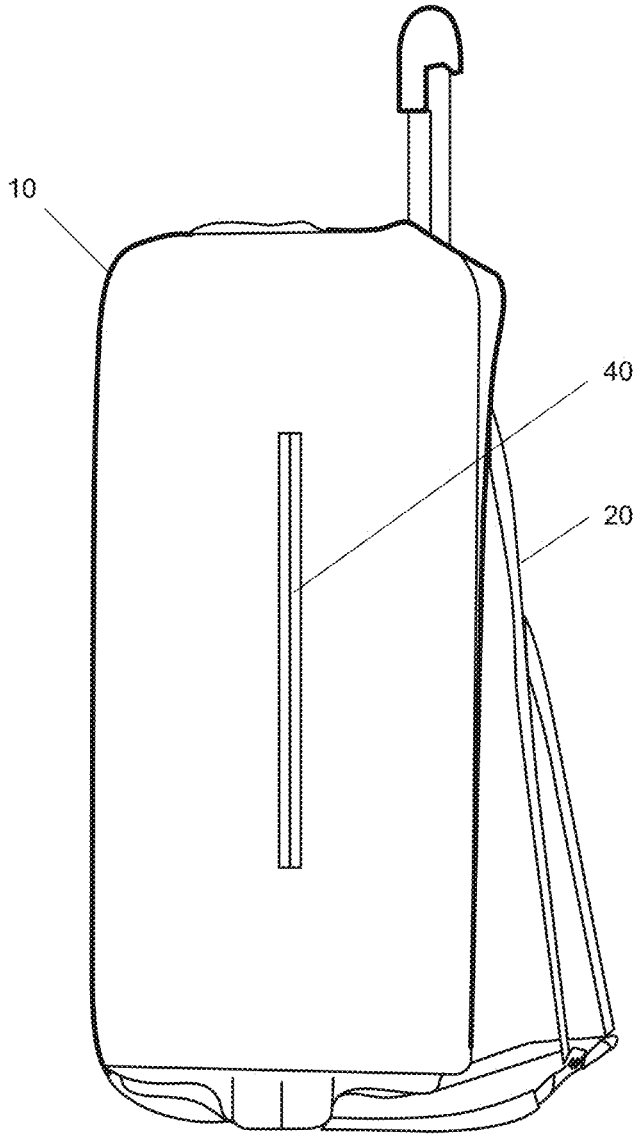
FIG. 5 is a side view of a luggage cover according to an embodiment of the present invention.

FIG. 5 is a side view of a luggage cover according to an embodiment of the present invention. In FIG. 5, the aperture 40 formed on the side panel and also shown in FIG. 1 is shown. The carrying handle or hand carry strap of the luggage container is exposed via the apertures 40, 50.

Figure 6:
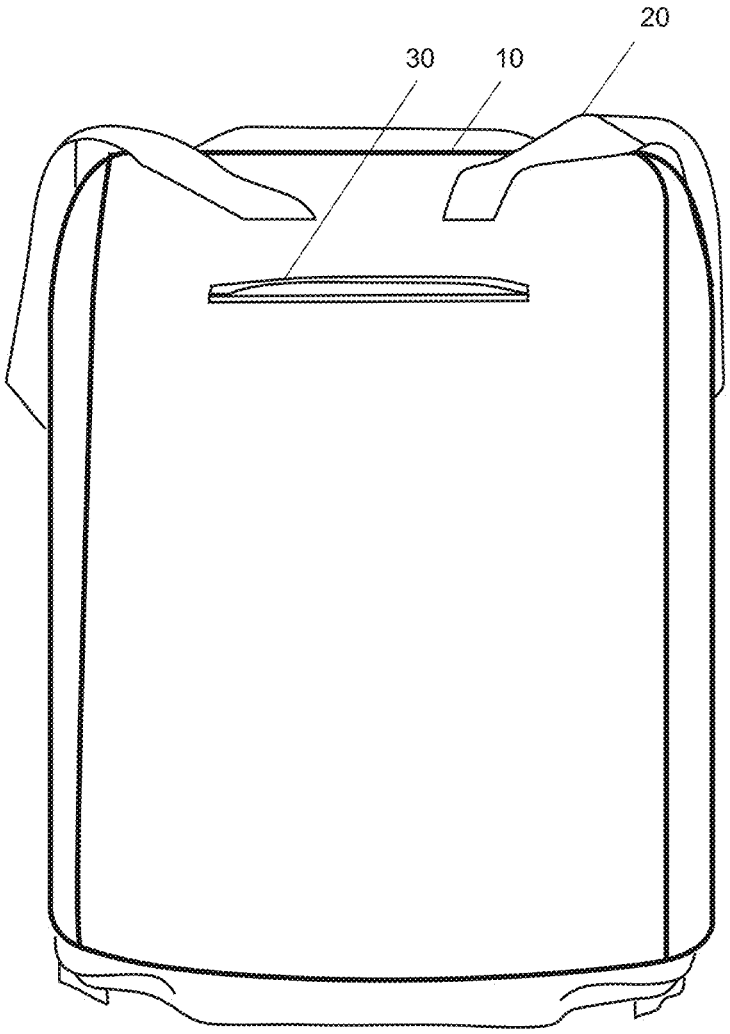
FIG. 6 is a rear view of a luggage cover according to an embodiment of the present invention.

FIG. 6 is a rear view of a luggage cover according to an embodiment of the present invention. Referring to FIG. 6, the pocket 30 formed on the rear panel of the luggage cover 10 is shown. For example, in FIG. 6, at least one ends of the shoulder straps 20 are not coupled to the luggage cover 10 such that portions of the shoulder straps 20 including the at least one ends may be stored in the open pocket 30.

Figure 7A:
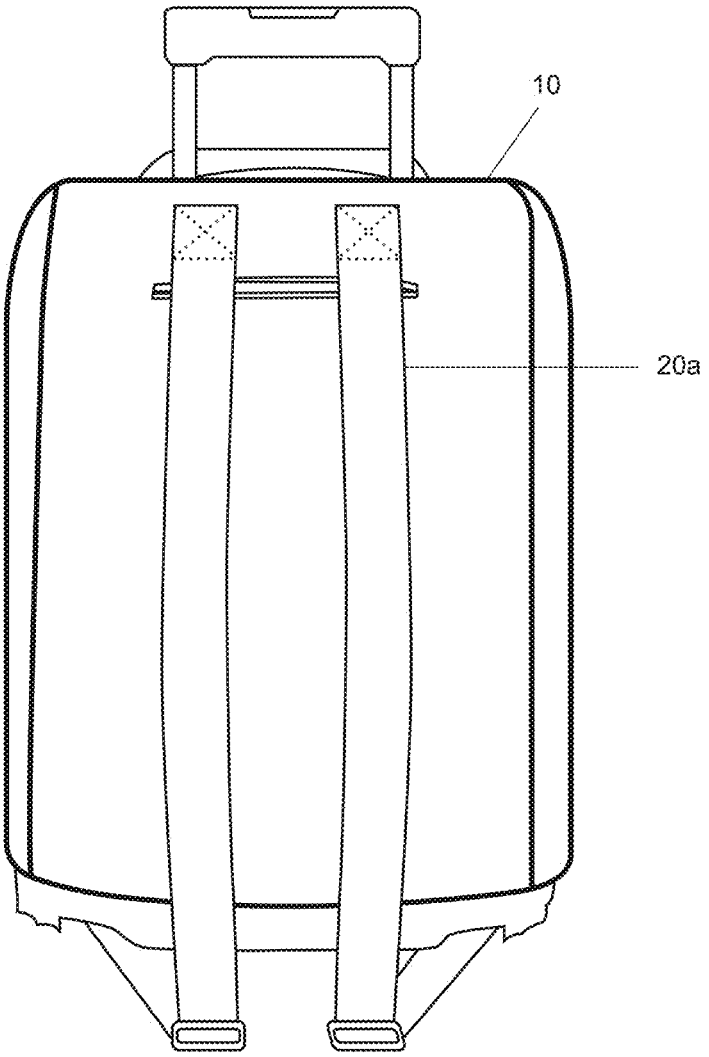
FIG. 7A is a rear view of a luggage cover with shoulder straps according to an embodiment of the present invention.

FIG. 7A is a rear view of a luggage cover with shoulder straps according to an embodiment of the present invention. Referring to FIG. 7A, according to an embodiment, the shoulder straps 20*a* may be permanently affixed to a top portion of the rear panel of the luggage cover 10. For example, one ends of the shoulder straps 20*a* may be stitched to the rear panel while the other ends of the shoulder straps 20*a* are not permanently affixed to the luggage cover 10. A length of the shoulder straps 20*a* may be adjustable. By having the shoulder straps 20*a*, the luggage cover 10 in which the luggage container is enclosed can be carried by a user like a backpack.

In another example, although not shown in the drawings, one ends of a pair of shoulder straps may be stitched to inside of the pocket 30 such that the pair of shoulder straps can be concealed in the pocket 30 when the other ends of the pair of shoulder straps are not attached to the luggage cover 10. Therefore, when a user wants to carry the luggage container enclosed within the luggage cover 10 in a backpack mode, the pocket 30 is opened, the pair of shoulder straps are taken out of the pocket 30, and the other ends of the pair of shoulder straps are attached to a portion of the luggage cover 10 to make the pair of shoulder straps wearable by the user.

Figure 7B:
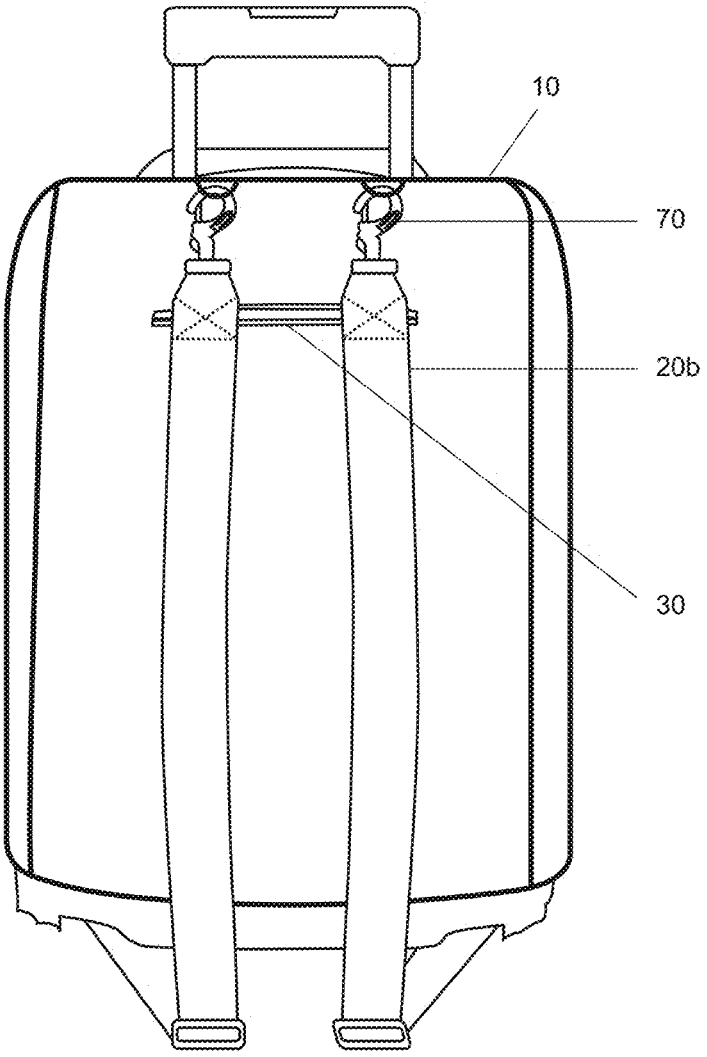
FIG. 7B is a rear view of a luggage cover with detachable shoulder straps according to another embodiment of the present invention.

FIG. 7B is a rear view of a luggage cover with detachable shoulder straps according to another embodiment of the present invention. Referring to FIG. 7B, according to another embodiment, a pair of shoulder straps 20*b* are attachable to or detachable from the luggage cover 10. The pair of shoulder straps 20*b* have two first ends, each first end with a first coupling member 70, and two second ends, each second end with a second coupling member 80 (not shown in FIG. 7B, but shown in FIGS. 8A-8C). For example, the pair of shoulder straps 20*b* may be attached to a top portion of the rear panel via the first coupling member 70. That is, the top portion of the rear panel of the luggage cover 10 may have a coupling member that can be coupled to the first coupling member 70.

Further, the second coupling member 80 may be coupled to a lower end portion of the front panel, to a lower end portion of the rear panel, to a portion where the front panel contacts the bottom panel, or to a portion where the rear panel contacts the bottom panel via a coupling member that is formed at the lower end portion of the front or rear panel and shaped to be coupled to the second coupling member 80. Furthermore, the first coupling member 70 and the second coupling member 80 may be detached from the luggage cover 10 by decoupling them from the coupling member(s) formed on the luggage cover 10. For example, the first coupling member 70 and the second coupling member 80 may have a locking mechanism such as a hook structure such that they can be coupled to ring-structured coupling members formed on the luggage cover 10. When the pair of shoulder straps 20*b* are detached from the luggage cover 10, they can be stored in the pocket 30 of the luggage cover 10.

Figure 8A:
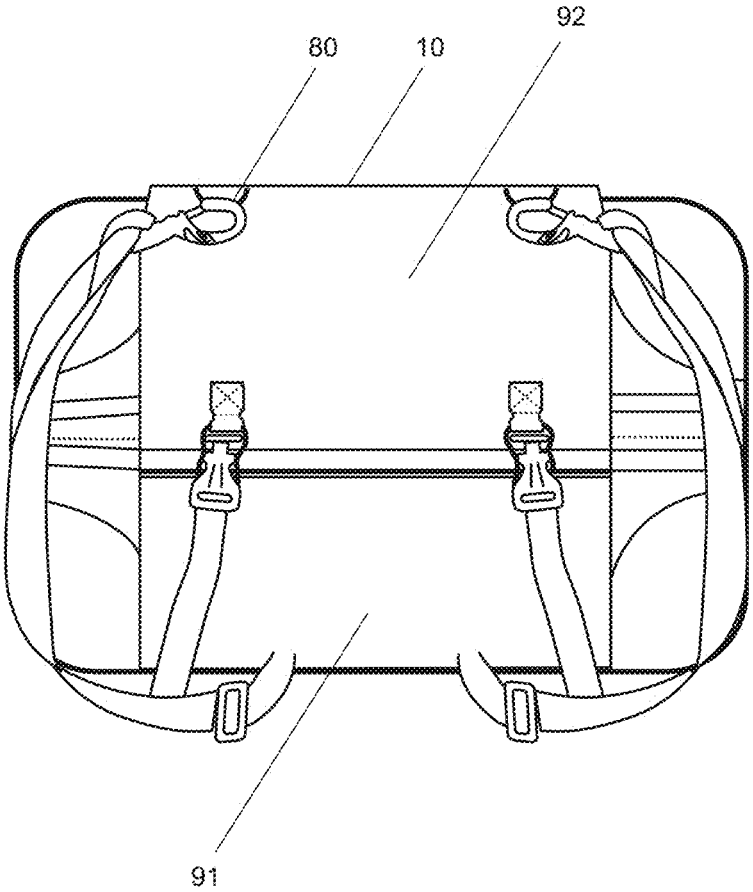
FIG. 8A is a bottom plan view of a luggage cover according to an embodiment of the present invention.
Figure 8B:
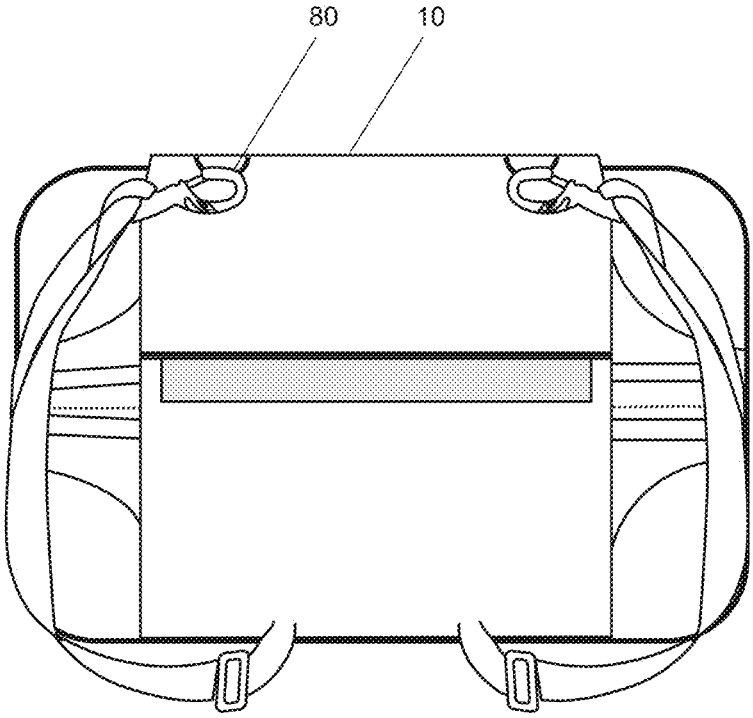
FIG. 8B is a bottom plan view of a luggage cover according to another embodiment of the present invention.
Figure 8C:
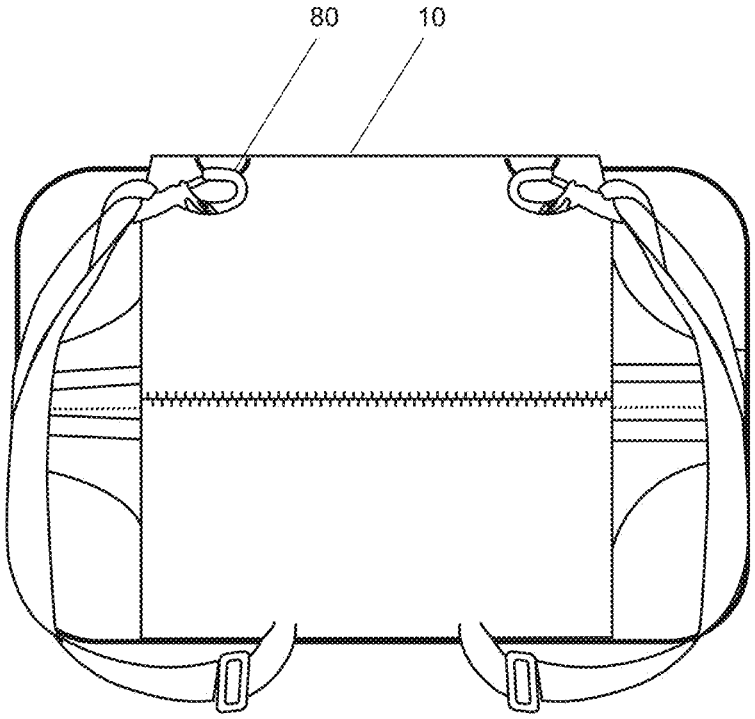
FIG. 8C is a bottom plan view of a luggage cover according to yet another embodiment of the present invention.

FIGS. 8A-8C show bottom plan views of luggage covers according to various embodiments of the present invention. Referring to FIGS. 1-8C, the luggage cover 10 has a plurality of panels including a front panel, a rear panel, a top panel, a bottom panel, a first side panel, and a second side panel. According to an embodiment, the plurality of panels are made of a weatherproof material. The plurality of panels are capable of being shaped into a protective shell for covering the luggage container since at least one panel among the plurality of panels, for example, the first side panel and the second side panel, is made of an expandable material or expandable fabric.

According to an embodiment, the bottom panel of the luggage cover 10 includes a first panel 91 coupled to an edge portion of the front panel and a second panel 92 coupled to an edge portion of the rear panel. When the first panel and the second panel are coupled to each other, they form the bottom panel of the luggage cover 10.

For example, the first panel includes a first fastening element that is configured to be coupled to a second fastening element of the second panel such that the bottom panel is in a closed configuration when the first fastening element and the second fastening element are coupled, and the bottom panel is in an open configuration when the first fastening element and the second fastening element are not coupled or uncoupled. The bottom panel may have a gap between the first panel and the second panel when the bottom panel is in the closed configuration such that at least a portion of a bottom of the luggage container is exposed via the gap.

Referring to FIG. 8A, according to an embodiment, the first fastening element and the second fastening element form an adjustable buckle strap such that a size of the bottom panel can be adjusted according to a size of the luggage container. Referring to FIG. 8B, according to another embodiment, the first fastening element has a hook structure and the second fastening element has a loop structure to form a hook-and-loop fastener. Referring to FIG. 8C, according to yet another embodiment, the first fastening element and the second fastening element form a zipper Further, a size of the bottom panel may be smaller than a size of the top panel. Such a structure of the bottom panel allows exposure of wheels of the luggage container even when the bottom panel is in the closed configuration if the luggage container includes the rolling wheels. Therefore, the luggage container having the wheels can still be carried by the handle and the rolling wheels even when the luggage container is covered with the luggage cover 10.

In alternative embodiments, the shoulder straps can take any known mechanism allowing the user to hold the luggage on the user's back. For example, the shoulder straps may have a single strap to place over one shoulder and body of the user while the user wears the luggage in the backpack mode.

Therefore, the foregoing description of the various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. A luggage cover for covering a luggage container, the luggage cover comprising:

a plurality of panels comprising a front panel, a rear panel, a top panel, a bottom panel, a first side panel, and a second side panel, the plurality of panels capable of being shaped into a protective shell for covering the luggage container;

an inner pocket formed on an inner side of the rear panel, an opening of the inner pocket formed on the rear panel; and a carrying element affixed to a portion of the rear panel that is located above the opening of the inner pocket, wherein:

the bottom panel comprises a first panel coupled to an edge portion of the front panel and a second panel coupled to an edge portion of the rear panel;

the first panel comprises a first fastening element that is configured to be coupled to a second fastening element of the second panel such that the bottom panel is in a closed configuration when the first fastening element and the second fastening element are coupled and the bottom panel is in an open configuration when the first fastening element and the second fastening element are not coupled or uncoupled;

the luggage cover is configured to receive the luggage container in the open configuration and is formed from pliable material to permit folding; and the luggage cover and the luggage container are completely separate from each other until the luggage container is received by the luggage cover.

2. The luggage cover of claim 1, wherein:

the first fastening element comprises a hook structure and the second fastening element comprises a loop structure to form a hook-and-loop fastener;

the first fastening element and the second fastening element form a zipper; or the first fastening element and the second fastening element form an adjustable buckle strap.

3. The luggage cover of claim 2, wherein:

the luggage cover comprises a hook-and-loop fasteners or a pair of buckle straps at the bottom panel; and a size of the bottom panel is adjustable according to tightening of the hook-and-loop fasteners or the pair of buckle straps.

4. The luggage cover of claim 1, wherein at least two of the plurality of panels are made of an expandable material or expandable fabric such that a size of the luggage cover is adjustable according to a size of the luggage container.

5. The luggage cover of claim 1, wherein the top panel comprises at least one aperture for exposing an external component of the luggage container, the external component comprising a handle or grip.

6. The luggage cover of claim 5, wherein at least the first side panel or the second side panel comprises at least one aperture for exposing an external component of the luggage container.

7. The luggage cover of claim 5, wherein the at least one aperture comprises:

a first aperture for exposing a handle of the luggage container that is used when the luggage container is hand-carried; and a second aperture for exposing an extendable handle of the luggage container that is extended when the luggage container is carried on wheels of the luggage container, the wheels exposed when the bottom panel is in the closed configuration.

8. The luggage cover of claim 5, wherein the at least one aperture is closed and opened by a zipper mechanism.

9. The luggage cover of claim 1, wherein the front panel, the rear panel, the top panel, the first side panel, and the second side panel are connected together by stitching.

10. The luggage cover of claim 1, wherein the opening is closed and opened by a zipper mechanism.

11. The luggage cover of claim 1, wherein:

the carrying element comprises a pair of shoulder straps having two first ends, each first end with a first coupling member, and two second ends, each second end with a second coupling member;

the pair of shoulder straps are attached to the top portion of the rear panel via the first coupling member; and the pair of shoulder straps are detachable from the luggage cover.

12. The luggage cover of claim 11, wherein:

the second coupling member is coupled to a lower end portion of the rear panel or to a portion where the rear panel contacts the bottom panel; and the first coupling member and the second coupling member are uncoupled from the luggage cover to detach the pair of shoulder straps from the luggage cover.

13. The luggage cover of claim 11, wherein the detached pair of shoulder straps are storable in the inner pocket.

14. The luggage cover of claim 11, further comprising a pair of second coupling members coupled to a lower portion of the rear panel, wherein the pair of first coupling members have a hook structure and the pair of second coupling members have a ring structure such that the pair of first coupling members and the pair of second coupling members are coupled by hooking the hook structure to the ring structure.

15. The luggage cover of claim 14, wherein the pair of first coupling members comprise a locking mechanism.

16. The luggage cover of claim 1, wherein the plurality of panels are made of a weatherproof material, and at least two of the plurality of panels are made of different materials.

17. The luggage cover of claim 16, wherein at least the first side panel and the second side panel are made of an expandable material or expandable fabric.

18. The luggage cover of claim 1, wherein at least two of the plurality of panels are connected together by stitching.

19. The luggage cover of claim 1, wherein:

the bottom panel has a gap between the first panel and the second panel when the bottom panel is in the closed configuration such that at least a portion of a bottom of the luggage container is exposed via the gap; and a length of a side of the first panel that is coupled to the edge portion of the front panel is shorter than a length of a side of the front panel corresponding to the edge portion of the front panel.

* * * * *